US005795103A

United States Patent [19]

Gaerlan

[11] Patent Number: 5,795,103

[45] Date of Patent: Aug. 18, 1998

[54] OIL TANKER AND METHOD FOR RECOVERING OIL FROM SUBMERGED OIL TANKER

[76] Inventor: Doroteo C. Gaerlan, No. 46 T. Arguelles St., Sta. Mesa, Manila, Philippines

[21] Appl. No.: 607,205

[22] Filed: Feb. 26, 1996

[51] Int. Cl.[6] ..... B63B 35/00

[52] U.S. Cl. ..... 405/188; 114/50; 405/60; 405/192; 405/210

[58] Field of Search ..... 405/60, 188, 190, 405/192, 210; 114/50, 74 R, 74 T, 256

[56] References Cited

U.S. PATENT DOCUMENTS

| | | | |
|---|---|---|---|
| 1,103,239 | 7/1914 | Zolling | 114/74 R |
| 3,890,796 | 6/1975 | Kruger et al. | 114/50 |
| 4,178,868 | 12/1979 | Iizuka et al. | 114/74 R |

*Primary Examiner*—Tamara L. Graysay
*Assistant Examiner*—Tara L. Mayo
*Attorney, Agent, or Firm*—Gregory J. Nelson

[57] ABSTRACT

A system for recovering petroleum products such as oil from a sunken oil transportation vessel. The system includes first and second flexible conduits communicating with the oil-containing compartments. The conduits are released upon the vessel becoming submerged. The free ends of the conduits are connected respectively to a pump for pumping sea water into the compartment to displace the oil. The second conduit is connected to a recovery container on the surface. The displaced oil is forced through the second conduit to the recovery container. The recovery container is, in the preferred embodiment, provided on a fleet or network of recovery vessels which then transport the recovered oil to port for off-loading. In the preferred embodiment, the flexible conduits are associated with a float which releases or carries the conduits to the surface so that underwater recovery operations are minimized.

7 Claims, 2 Drawing Sheets

OIL TANKER AND METHOD FOR RECOVERING OIL FROM SUBMERGED OIL TANKER

FIELD OF THE INVENTION

The present invention relates to a system for recovering oil from a marine vessel and more particularly relates to a system which facilitates immediate recovery of oil from a sunken or submerged vessel such as an oil tanker or barge. The present invention is particularly applicable to situations in which the oil is contained in a sunken vessel, such as a tanker or barge which is at a depth which makes pumping of the oil from the vessel difficult or impossible thereby impeding immediate retrieval of the oil before spillage or leakage occurs which will result in severe, detrimental environmental effects.

BACKGROUND OF THE INVENTION

Petroleum products such as crude oil, bunker oil, diesel oil, and gasoline are conventionally transported in bulk quantities in ocean-going vessels such as selfpropelled barges, tankers or super tankers. Tankers often have a number of compartments which may contain from 1,000 to as many as 24,000 barrels of oil. The large super tankers may have a capacity of one to two million barrels of oil.

Tankers and barges, when in transit on the ocean, are exposed to various maritime perils which may cause the vessel to sink, necessitating immediate salvage of the oil cargo both for economic and environmental reasons. The environmental effects of spills or leakage from sunken vessels or vessels run aground are well known and result in harm to both the ecology and the environment In addition, the loss of the oil due to spillage or leakage represents a substantial economic loss to the owners.

Thus, there exists a need for a simple, effective and expedient system of removing and recovering oil from sunken vessels, particularly those which rest in depths of greater than 10 or so meters. A vessel sunk below this depth presents particular problems. Conventional recovery methods generally require that pipes or conduits be connected to the various compartments so that the oil may be pumped from the compartments to a surface recovery. However, if the vessel is below 10 meters or so, pumping is difficult because of the substantial suction required which often will exceed the capacity of pumping equipment. Further, making connections to a sunken vessel requires the use of divers working at excessive depths which can be hazardous.

In addition, rough seas or weather can substantially complicate recovery attempts, increasing the hazards to divers and other recovery personnel.

Accordingly, there exists a need for a simple, expedient and effective system for recovering oil from sunken oil vessels such as tankers and super tankers.

Accordingly, it is a primary object of the present invention to provide a system which allows the immediate and expedient recovery of oil from vessels which are sunk and which accommodates the transfer of the oil to a surface vessel from the sunken vessel, minimizing the environmental exposure.

The present system can be easily applied as original equipment on new vessels or can be easily retrofit to existing vessels.

The system is complimentary to double hull construction and is inexpensive to install.

The present system also overcomes or eliminates spillage problems attendant to conventional recovery systems. In many situations, sunken vessels represent a substantial environmental problem if recovery attempts fail. The failed oil recovery attempts often result in release of the oil. For this reason, many owners and insurance companies will not risk recovery attempts and therefore the sunken vessel is left to allow nature to take its course which ultimately may result in release of the oil due to movement of the submerged vessel which would occur over a period of time.

The present invention relies in a system in which water such as sea water is pumped into the oil-containing compartments of the vessel in distress.

There are several prior art patents which disclose methods and apparatus for displacing oil and sea water in tanks of an oil tanker. However, these patents do not disclose displacement systems for recovering oil from a tanker in distress.

The early patent to Zolling, U.S. Pat. No. 1,103,239, relates to an improved tanker which has means for rapidly discharging the fluid through a series of suction pipes which project within the compartments. Inlet pipes are connected at suitable locations to sea cocks in the hold of the vessel below the water line and will admit water into the hold of the vessel to float the oil which has a lighter specific gravity than water. The suction pipes are provided with float valves so that as the level of the oil recedes to a point adjacent the lower end of the suction pipes, sea cocks are open to permit seawater to flow into the compartments. The floats are weighted so as not to be floated by the water until the water has reached a point where substantially all of the oil has been displaced. After the oil has been withdrawn from the compartment, the sea cocks are closed and the water is pumped or discharged from the compartments.

Another patent which shows use of seawater for displacing oil is U.S. Pat. No. 4,178,868. This patent relates to a ballasting method for an oil tanker. The patent points out that oil tankers in transit are often empty or near empty. To reduce the possibility of capsizing and to stabilize the ship, it is common to ballast the ship by filling the tanks with seawater. The '868 patent suggests employment of a resilient membrane within the compartments to reduce contamination of the seawater used for ballast.

As pointed out above, while both of the above patents suggest pumping of seawater into oil tanker compartments, neither suggest such an operation in connection with recovery of oil from a sunken vessel.

SUMMARY OF THE INVENTION

Accordingly, the present invention provides a system for recovery of oil cargo from a sunken vessel. The system includes a recovery vessel as pumping means capable of pumping, forcing sea water into the oil-containing compartments of the sunken vessel. Water has a greater specific gravity than petroleum products and will displace the petroleum products in the vessel. A container connected to a discharge of the compartment of the sunken vessel receives the displaced oil. The container may be on the same vessel as the pump or may be associated with a separate vessel so that when the recovery vessels are filled to capacity they may be returned to port and replaced with another recovery vessel. The operation continues until all of the oil in the various compartments in the sunken vessel is transferred to a recovery vessel on the surface. Alternatively, water may be introduced into the compartments of the sunken vessel by divers opening the sea cocks, although it is preferred that connections for pumping water into the compartments of the vessel in distress and for recovering the displaced oil be on the surface.

To accomplish this, the various compartments of the oil-containing vessel are provided with inlet and discharge conduits which are flexible and normally stored in a collapsed, compact condition. The conduits have float means associated therewith so that upon submersion of the sinking vessel, the floats will be released to the surface carrying the water intake and oil discharge hoses to the surface for retrieval and connection by the recovery crew.

The other objects and advantages of the present invention will become apparent upon reading the following description, claims taken in conjunction with the accompanying drawings in which:

Figure 4:
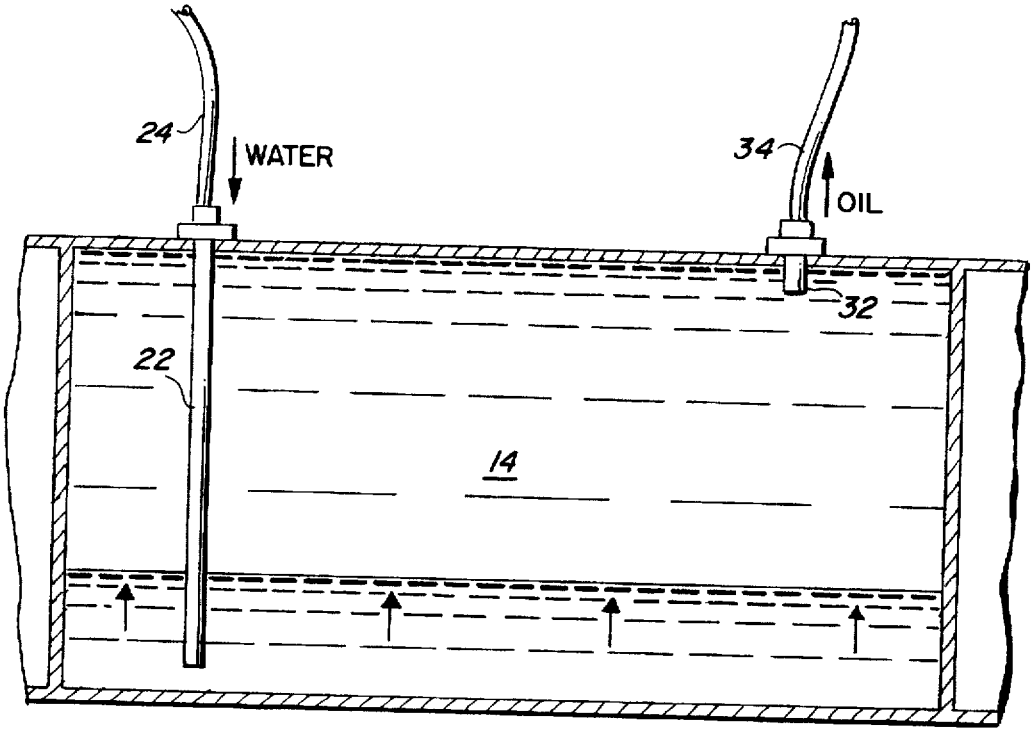
Figure 5:
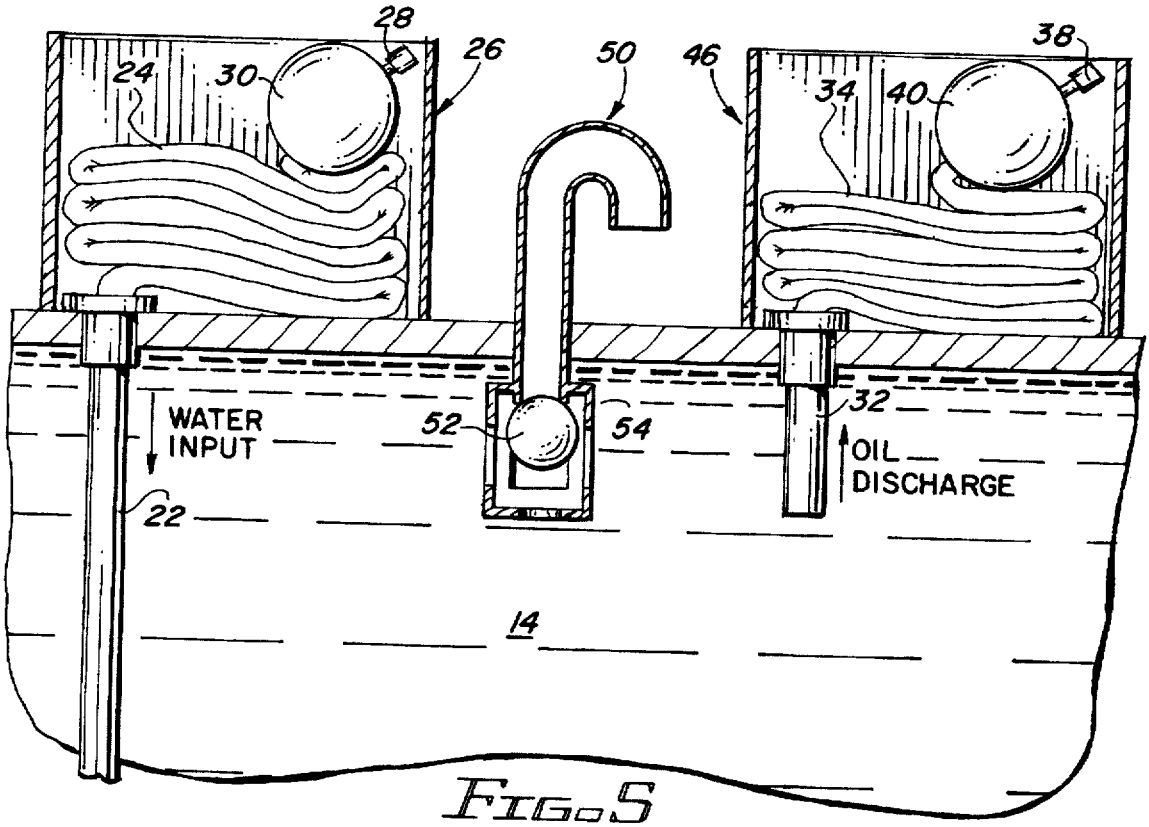

FIG. 4 is a cross-sectional view of a compartment of a tanker equipped with the recovery system illustrating the displacement of the oil contained within the compartment by a higher specific gravity fluid such as water during the recovery process; and FIG. 5 is a detail view illustrating the stored position of the displacement and recovery conduits as well as the venting arrangement associated with the various compartments of the oil tanker.

Figure 1:
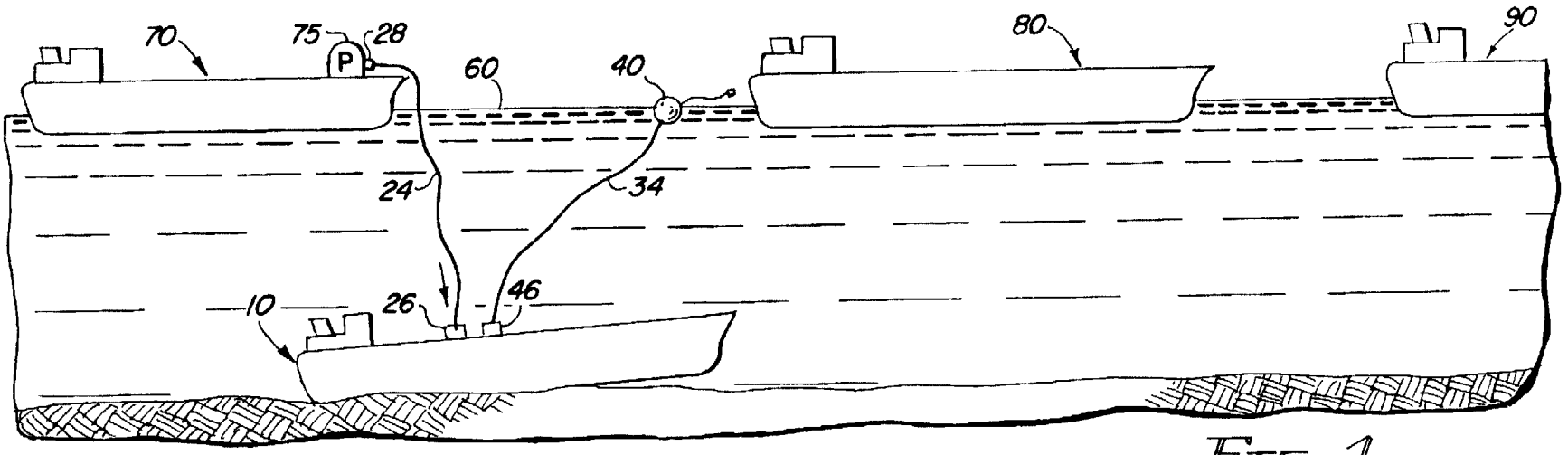
FIG. 1 is a schematic representation of the system of the present invention showing a submerged or sunken vessel connected to a pumping and a recovery vessel on the surface.
Figure 2:
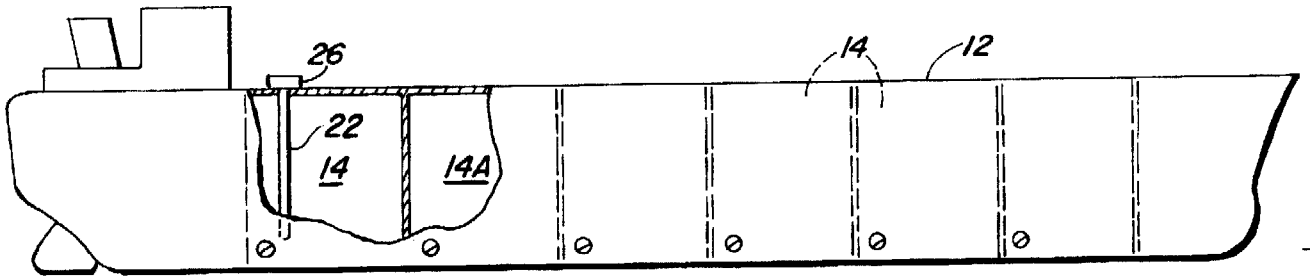
FIG. 2 is a cross-sectional view representative of a double hull tanker equipped with the oil recovery system of the present invention.
Figure 3:
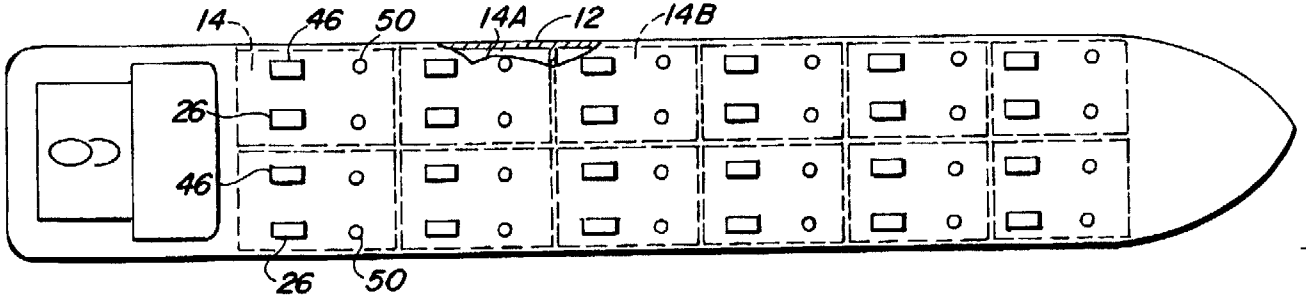
FIG. 3 is a plan view of the tanker shown in FIG. 2.

Referring to FIG. 1, a recovery situation is shown in which the system of the present invention is employed. Vessel 10 is shown submerged having sunk. Vessel 10 is an oil tanker or barge having one or a plurality of oil-containing compartments. As shown in FIGS. 2 and 3, the vessel 10 is shown having a hull 12 and which is of the double hull construction for further protection of the contents where upon puncture damage to the outer hull section only will not result in release of the contents of the various compartments 14, 14A, 14B, etc., as the inner hull protects against damage. The various compartments, 14, 14A, etc. are adapted to receive petroleum products and are covered by an upper deck 16. Each compartment has conventional connections 18 and 24 filling and withdrawing oil from the compartments.

In addition to the conventional filling and discharge connections, the various compartments 14, 14A, etc. of the present invention are provided with components of the recovery system of the present invention as shown in FIG. 5. These components include an inlet pipe 22 depending within the compartment 14 a suitable distance such as to a location above the floor of the compartment. The inlet pipe 22 is connected to a flexible conduit 24 which may be flexible rubberized fabric. The flexible conduit 24 is normally stored in a folded condition as shown in FIG. 5 within a housing or compartment 26. The conduit 24 is connected to the upper end of the pipe 22. The conduit may be of any suitable length as for example 100 meters in length having at its opposite end a suitable coupling 28 to facilitate attachment to the discharge side of a pump. In addition, a float 30 is attached at or adjacent the coupling 28.

Also, communicating with the compartment 14 is a discharge which includes a discharge pipe 32 which communicates with the interior of oil-containing compartment 14. The discharge pipe is similarly connected to a flexible conduit 34 which is of a suitable material such as a rubberized fabric and may be of a length comparable to conduit 24. The opposite end of conduit 34 is provided with a fitting 38 which is adapted to be easily coupled to the inlet of an oil-receiving compartment of a recovery vessel. A float 40 is positioned near the fitting 38. The 5 oil discharge conduit 34 is normally stored in a folded, collapsed position as shown in FIG. 5 within a suitable housing 46 on the deck of the vessel.

A vent 50, as is conventional, communicates with the normal free-board area above the oil level in the compartment 14 and is provided with a float valve 52 in a suitable cage 54. The float being selected so that it will close off vent pipe 50 as the fluid level within the chamber 14 rises to the level of the float 52. Referring again to FIG. 1, the vessel 10 is shown in a sunken position a substantial distance above the ocean level 60. The recovery system includes a vessel 70 which is provided with a pump 75 for pumping sea water in volumes and at sufficient pressure to fill the compartments 14 of the sunken vessel 10. In addition, the recovery system includes one or more recovery tankers 80 and 90 which are positioned to receive the oil recovered from the sunken vessel 10. The vessels 70 and 90 may be a single vessel but it is preferred that the recovery vessels 80 and 90 be separate vessels so that when they are filled they may be sailed to port and unloaded. Additional recovery vessels 90 are ready for attachment to the sunken vessel when the initial recovery vessel 80 is filled to capacity.

As seen in FIG. 1, conduits 24 and 34 of the second vessel have deployed to the surface which occurs automatically as a result of each of the conduits being attached to a float. Float 40 is shown on the surface of the ocean 60 ready to be retrieved and attached to oil recovery vessel 80. Conduit 24 is shown in the position of having been retrieved and attached to pumping unit 85 at 75 at coupling 28. Once conduit 34 is retrieved and properly connected to recovery vessel 80, pumping of water such as sea water is initiated. As the sea water enters compartment 14, oil is displaced and will be forced through conduit 34 to the recovery vessel. The check float valve 52 will close off vent 50 so oil is not discharged through the vent 50. The operation proceeds until compartment 14 is evacuated of oil. Conduits associated with the additional compartments, 14A and 14B, are sequentially attached to the pump 28 and to the recovery vessel and the operation proceeds until all oil is recovered.

In FIG. 1, only conduits associated with compartment 14 have been shown for clarity. It will be apparent that there will be a number of conduits released to the surface as oil tankers conventionally have multiple compartments. For clarity of illustration, only conduits 24 and 34 are shown.

The floats which release the conduits communicating with the oil compartments, provide significant advantages. The floats carry the conduits to the surface so that connection to the pressure source, that is pump 75, and the recovery vessels can all be accomplished on the surface. It is, of course, possible that instead of connecting pump 75 to conduit 24 to provide a source of pressurized sea water, that sea cocks associated with each of the compartments could be opened. However, this operation would necessitate the use of divers.

Another advantage of the present system is that the floats, since they will assume a position on the surface of the water, will provide a marker for clearly indicating the location of the sunken vessel. The present system does not disturb the ship so that the possibility of inadvertent release of oil from the sunken vessel is substantially reduced.

As indicated above, the recovery system of the present invention which incorporates conduits which release in the event of the sinking of a vessel may easily be incorporated into new ship construction or may be easily retrofit at minimum of cost. The system also has the advantage in that recovery can be accomplished even in heavy weather conditions as divers are normally not required in the recovery operation. The system also has the advantage in that recovery can be accomplished with vessels sunk at depths below ten or so meters which normally poses substantial recovery problems.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. A method for recovering oil from an oil transport vessel having at least one oil-containing compartment submerged below the water level comprising:

(a) providing an inlet communicating with said at least one oil-containing compartment, said inlet having an attached flexible inlet line with floating means associated therewith exterior of said at least one compartment;

(b) providing a discharge communicating with said at least one oil-containing compartment, said discharge having an attached flexible discharge line with floating means associated therewith exterior of said at least one compartment;

(c) deploying said floating means causing said inlet and discharge lines to rise to the water surface upon said vessel becoming submerged;

(d) retrieving said inlet and discharge lines and connecting said inlet line to a source of water and connecting said discharge line to a recovery vessel at the surface; and (e) forcing water into said at least one oil-containing compartment through said inlet line displacing the oil to cause the oil to flow to said recovery vessel through said discharge line.

2. The method of claim 1 wherein said water is forced into said at least one compartment by a pump located above the water level.

3. The method of 1 further including providing venting means in said at least one oil compartment and causing said venting means to close when water is forced into said at least one oil compartment.

4. The method of claim 1 including providing multiple recovery vessels.

5. An oil tanker comprising:

(a) a hull having at least one oil-containing compartment;

(b) an inlet communicating with said at least one compartment, said inlet having a flexible inlet line with one end attached to said inlet and a free end and with floating means associated exterior of said at least one compartment;

(c) a discharge communicating with said at least one compartment, said discharge having an attached flexible discharge line with one end attached to said discharge and a free end with floating means associated therewith exterior of said at least one compartment; and (d) means maintaining said inlet line, discharge line and floating means exterior of said at least one compartment whereby said inlet and discharge lines will be caused to be deployed to rise to the surface upon said vessel being submerged.

6. The oil tanker of claim 5 wherein said inlet and discharge lines are normally maintained in a collapsed condition within a housing on the vessel and wherein each of said lines includes coupling means at their free ends respectively attachable to a water source and to a recovery container.

7. The oil tanker of claim 5 wherein said at least one oil compartment has a floor and includes an inlet pipe extending from said inlet to near the floor of said at least one compartment.

* * * * *